United States Patent [19]

Clark et al.

[11] 4,272,463

[45] Jun. 9, 1981

[54] PROCESS FOR PRODUCING METAL POWDER

[75] Inventors: Ian S. R. Clark, Greenwood Lake; John K. Pargeter, Warwick, both of N.Y.

[73] Assignee: The International Nickel Co., Inc., New York, N.Y.

[21] Appl. No.: 736,119

[22] Filed: Oct. 27, 1976

Related U.S. Application Data

[63] Continuation of Ser. No. 533,756, Dec. 18, 1974, abandoned.

[51] Int. Cl.[3] ..... B01J 2/06

[52] U.S. Cl. ..... 264/12

[58] Field of Search ..... 264/12

[56] References Cited

U.S. PATENT DOCUMENTS

| | | | |
|---|---|---|---|
| 2,967,351 | 1/1961 | Roberts et al. | 264/12 |
| 3,009,205 | 11/1961 | Monson et al. | 264/12 |
| 3,469,961 | 9/1969 | Barnhart et al. | 264/12 |
| 3,556,780 | 1/1971 | Holtz, Jr. | 264/12 |
| 3,663,206 | 5/1972 | Lubanska | 264/12 |

*Primary Examiner*—Donald E. Czaja
*Assistant Examiner*—James R. Hall
*Attorney, Agent, or Firm*—Raymond J. Kenny

[57] ABSTRACT

The invention is directed to a process for producing metal powder through atomizing in which a molten metal stream is subjected to the influence of a plurality but correlated sets of atomization jets by virtue of which a disintegrating medium exits from the jets at a velocity of at least Mach No. 1, the medium from one set of jets being angled to strike the falling molten body at a point below and at an angle less than the medium dispensed from the other set of jets, whereby less flake and filigree are formed, a higher powder yield obtains, lower medium pressure can be used, etc.

11 Claims, 6 Drawing Figures

SCHEMATIC CROSS-SECTION OF MAIN COMPONENTS OF ATOMIZER

CROSS-SECTIONS OF TWO DIFFERENT TEEMING NOZZLES

PLENUM CHAMBER PREFERRED SHAPE

DESIGN OF JETS WITH DIMENSIONS

Figure 1:
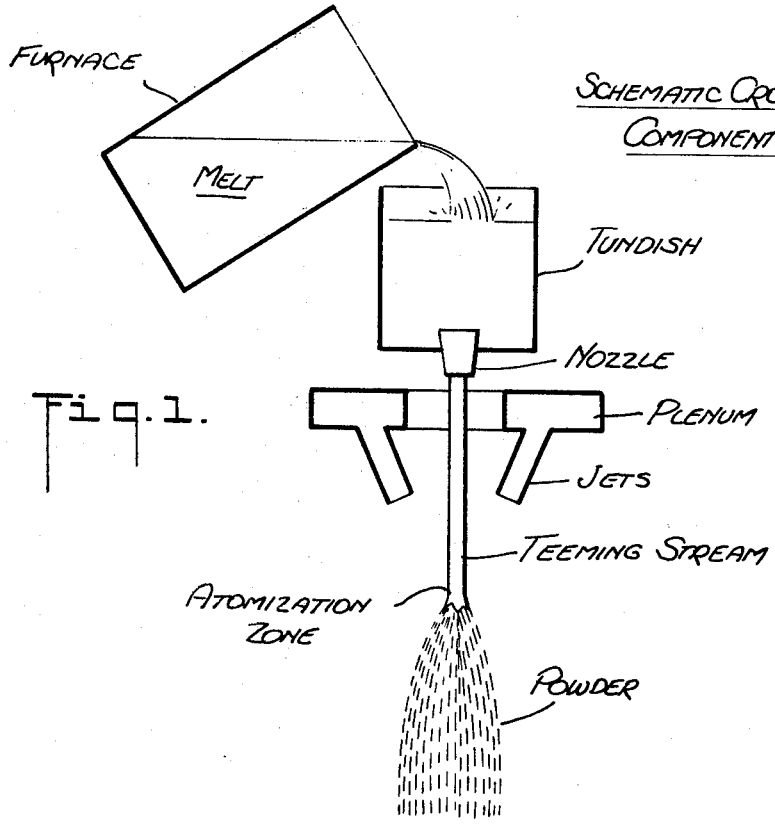

| | | JET NO. | | | | | |
|---|---|---|---|---|---|---|---|
| | | A | AA | B | BB | C | CC |
| THROAT DIAMETER | A (IN) | 0.156 | 0.156 | 0.141 | 0.141 | 0.141 | 0.141 |
| EXIT DIAMETER | B (IN) | 0.212 | 0.212 | 0.205 | 0.205 | 0.227 | 0.227 |
| LENGTH OF TAPER | C (IN) | 0.533 | 0.533 | 0.611 | 0.611 | 0.821 | 0.821 |
| LENGTH OF EXIT | D (IN) | 0.717 | 1.217 | 0.639 | 1.139 | 0.429 | 0.929 |
| EXTENSION FROM PLENUM | E (IN) | 1.5 | 2.0 | 1.5 | 2.0 | 1.5 | 2.0 |
| LENGTH OF JET | F (IN) | 2.0 | 2.5 | 2.0 | 2.5 | 2.0 | 2.5 |

SCHEMATIC ARRANGEMENT OF JETS IN THE PLENUM SHOWING THE LENGTH OF JETS EXTENDING FROM THE PLENUM AND THE DISTANCES FROM THE EXIT OF JETS TO THE FOCAL POINTS.

Theoretical Kinetic Energy Generated At The Exit Of A Correctly Designed Supersonic Jet With Throat Diameter $D^*$ As A Function Of The Driving Pressure Of Argon.

PROCESS FOR PRODUCING METAL POWDER

This is a continuation of application Ser. No. 533,756, filed Dec. 18, 1974, now abandoned.

The subject invention is addressed primarily to powder metallurgy, particularly to the production of superalloy metal powders through the disintegration of molten metal streams by atomization.

As is known, over the years research efforts have been intensified in respect of the development of superalloys capable of withstanding the increasingly severe operating conditions, notably higher temperatures and stress, imposed by reason of advanced designs, intended applications, etc. This has been particularly evident, for example, in turbine engine development. And in response to such demands, a number of alloys, usually of a nickel, cobalt or iron base, possessing the necessary metallurgical properties have been developed.

But, the achieving of such properties has given rise to a serious attendant problem, to wit, poor hot workability and fabrication characteristics. Some of the most promising alloys developed, usually those of highest strengths at the more elevated temperatures, upon melting and casting cannot, as a practical matter, be hot worked, let alone otherwise fabricated. As a consequence, such alloys have been normally produced and used in the cast form. Apart from such drawbacks as "segregation" abnormalities associated with cast structures, the cast form is inherently self-limiting with regard to properties and product shapes that can be produced.

In an effort to circumvent the hot working and fabrication difficulties, the art has turned to powder metallurgy. And incident to this, the production of the powder per se has been accorded particular attention. In this connection and as has been suggested elsewhere, there are nearly as many ways to produce metal powders as there are metals from which they are produced, including atomization, chemical reduction, mechanical comminution, etc. It is the former which is of concern here, particularly gas atomization.

While both gas and water atomization are commonly used, the latter has probably seen greater general use ostensibly because of its seemingly innate ability to deliver powders of high density, its ability to provide quenched powders more readily and, not unimportantly, it is normally more economical. But these powders, irregular in shape, contain appreciable quantities of oxygen, an undesirable contaminant in a number of alloys.

While it would be impossible to consider the innumerable proposals heretofore advanced in respect of gas atomization, a cursory review of the literature would seem to suggest there are two general approaches to directing gas, usually argon or nitrogen, at a metal stream. One technique involves the use of a plenum chamber having an annular opening in the bottom thereof to exhaust gas in a downward manner concentric with the flowing metal stream. The lower bore of the metal teeming nozzle diverges outwardly such that the metal stream is caused to spread outwardly in a controlled manner under the influence of a vacuum generated within the cone of surrounding gas. In a variation of this, high velocity gas is passed through two plenum chambers to swirl the gas and enhance the atomization process.

In the second approach a series of separate openings are used in the plenum chamber rather than the annular concept. The benefit here is said to follow from directing the gas at the circumference of the metal stream as opposed to its axis, thus causing a swirling effect to aid atomization. Modifications have included the use of nozzles in lieu of bored holes in the bottom of the plenum chamber. This is said to be expensive such that water cooled surfaces have been used as the cooling medium.

In contrast to the emphasis accorded the direction a gas should be caused to flow to produce powder, our review of the literature, albeit not exhaustive, rather indicates that comparatively scant attention has been given to the energy level that should, as we believe, be delivered to the molten metal stream. This aspect forms a part of the instant invention since it has been found that finer powder particle sizes obtain, a result probably due to the larger surface areas generated by reason of the high energy plateaus developed. But imparting high energy to a molten metal stream would normally suggest even higher costs than that heretofore associated with gas atomization.

In accordance herewith, however, a most substantial cost reduction is effected. This is largely brought about by the fact that we have devised a process by which low pressure gas can be used, e.g., as low as 120 psig, and a minimum mass of gas as well, the gas being controlled through a multiplicity of venturi-type gas jets in combination with a correlated teeming nozzle, etc., as will be herein described. Argon costs (perhaps the most costly item) alone are reduced by at least one-half in comparison with conventional processes (which virtually all rely on much higher gas pressures, e.g., 240–270 psig), since, given the present invention, low pressure gas can be supplied with standard equipment directly from a liquid phase evaporator. Yet powder yield is exceptionally high. Normally lower gas consumption is the antithesis of higher yields.

Moreover, the invention in its most advantageous embodiment (double impact mode) provides for a narrow profile, i.e., a narrow cone of falling powder such that there is a more intimate gas-to-metal contact. This has several benefits. First, there is a marked reduction in both flake and filigree formation. By way of explanation, in conventional processes as the metal droplets are formed they descend in a most distinct "diverging" pattern. A goodly portion of the droplets hits the sides of the enclosing chamber. The droplets, being very hot, if they have not sufficiently solidified and cooled, either deflect off the inner chamber wall and form flakes or stick and form filigrees. In either case, powder recovery obviously suffers, and both clean-up and tap-to-tap times are increased. This is most substantially minimized by the instant invention, yields as high as 96–98% being obtainable.

Second, the narrow cone of falling powder results in such a gas-to-metal interface and efficient heat transfer therebetween that the temperature range of atomized powder reaching the bottom of the enclosing chamber is greatly reduced. In the case of superalloys, we have found that temperatures as low as 550° F. to 750° F. are not uncommon. This compares with temperatures well over 1500° F. characteristic of other processes. Too, it is thought that the intimate gas-to-metal contact in the narrow cone likely helps decrease the volume of gas otherwise required to cool the falling powder. In any event, the need for such currently used equipment and techniques as elaborate gas recirculation-refrigeration cycles, inert cryogenic liquids, externally cooled hearths, etc. have been obviated.

Third, the narrow cone profile enables smaller holding tank diameters to be used and a "multiple" of atomized streams can be formed in a single tank without the spray of one stream detrimentally interfering with another. Therefore, production rates can be readily increased without the necessity of having to extrapolate beyond available gas and metal flow rates.

Fouth, apart from excellent powder yields, practically all the powder can be produced within a desired particle range and of desired particle distribution. Of the many superalloys experimentally produced to date, particle size has been within the desired range of −40+325 mesh (U.S. Series). And since argon was used, subversive oxygen contamination was avoided.

Figure 2:
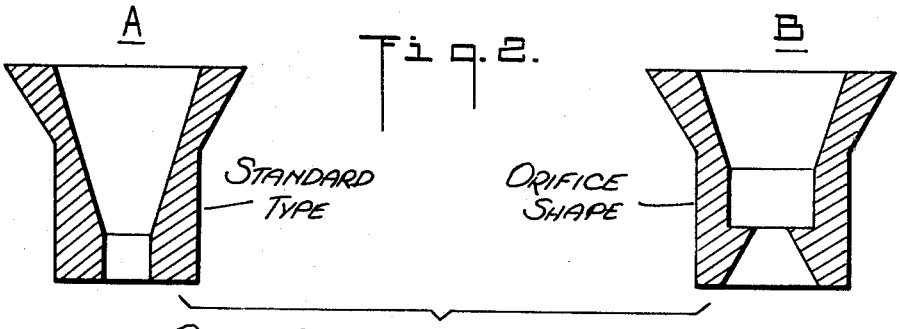
Figure 3:
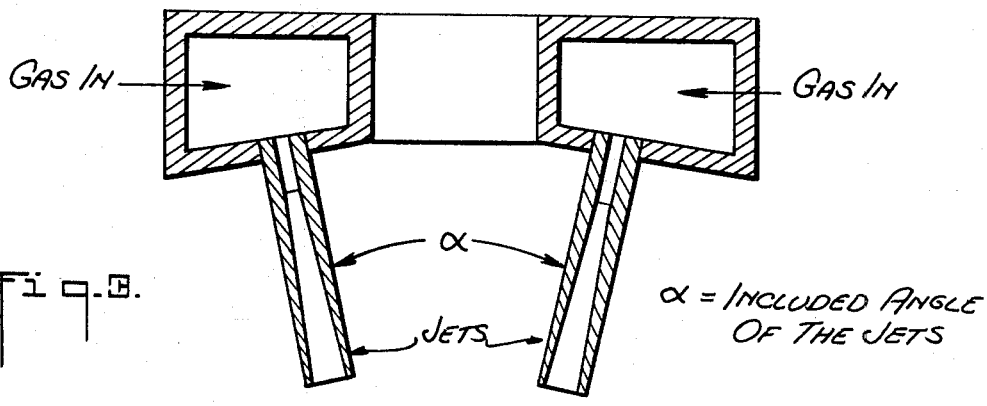
Figure 4:
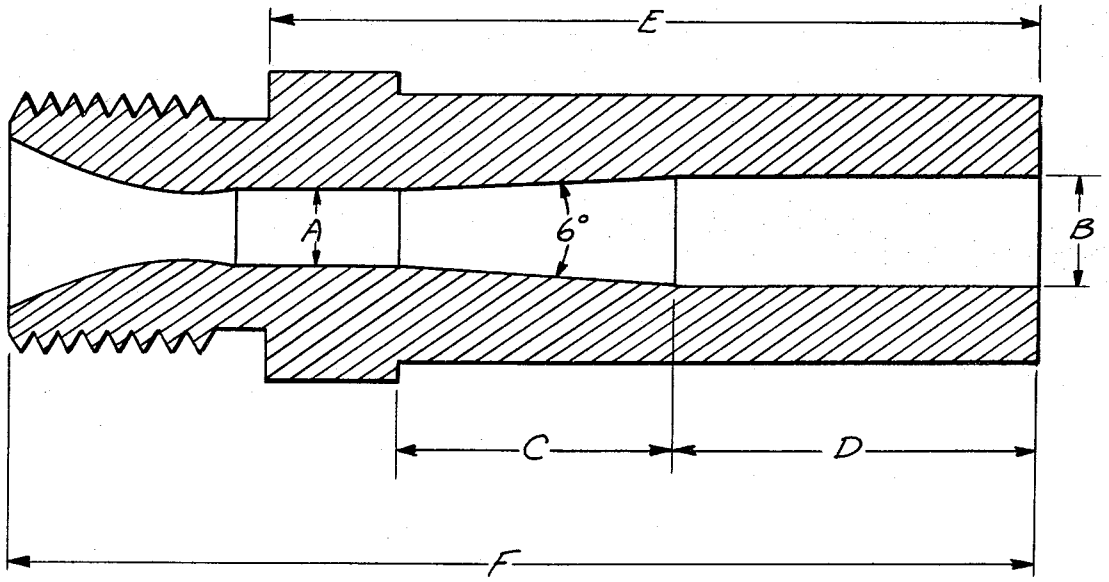
Figure 5:
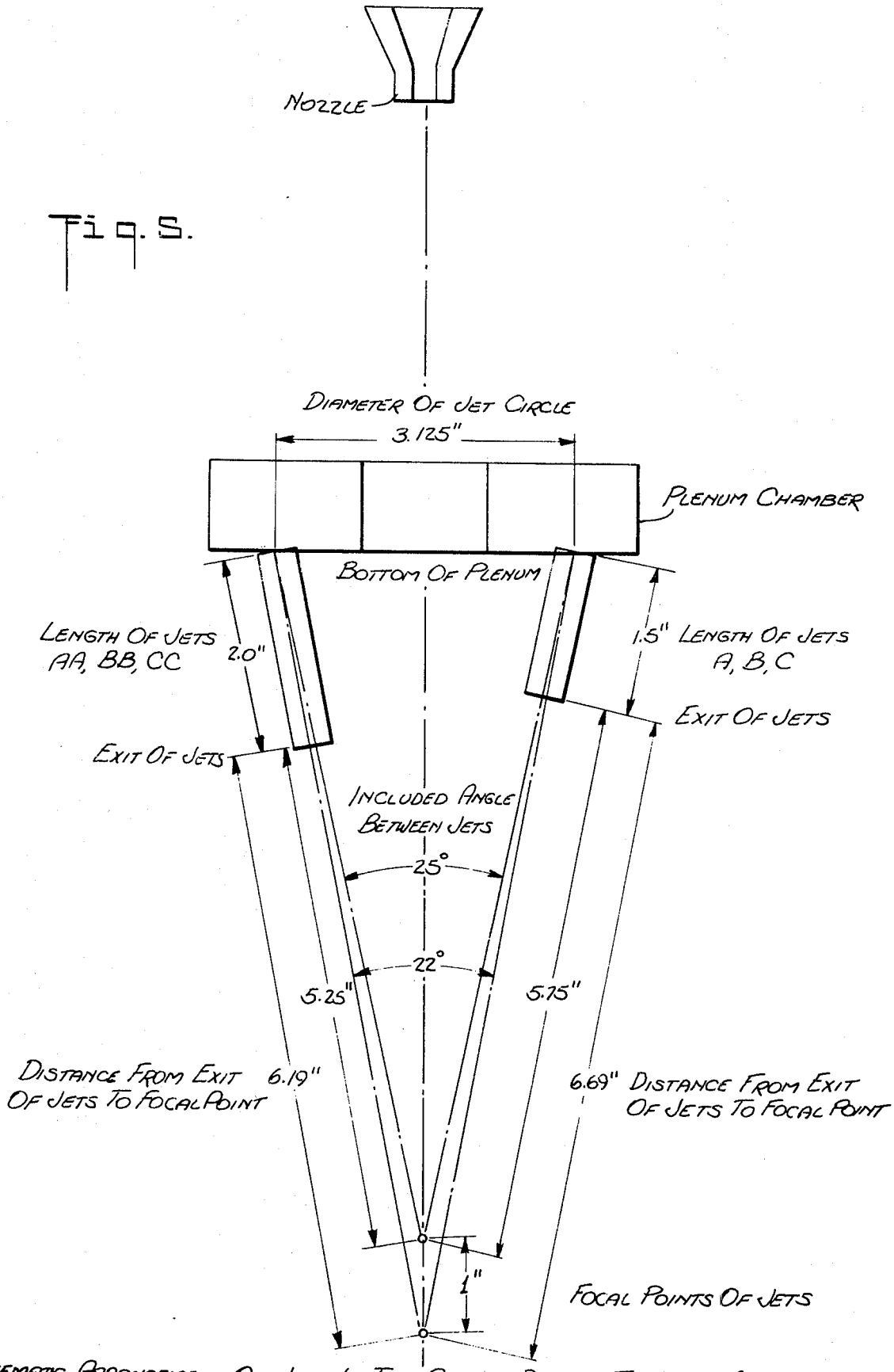

Other advantages of the invention will become apparent from the following description and accompanying drawings in which:

FIG. 1 is simply a schematic arrangement in depicting the principal components of the subject atomization assembly;

FIGS. 2(*1*) and 2(*b*) illustrate two different tundish teeming nozzles, a smooth bore venturi and sharp-edge orifice, respectively;

FIG. 3 schematically represents in section a plenum chamber;

FIG. 4 reflects the profile of a preferred gas jet embodiment;

FIG. 5 schematically depicts one of the most advantageous embodiments the plenum plus the gas jets arranged to strike a molten metal stream.

Figure 6:
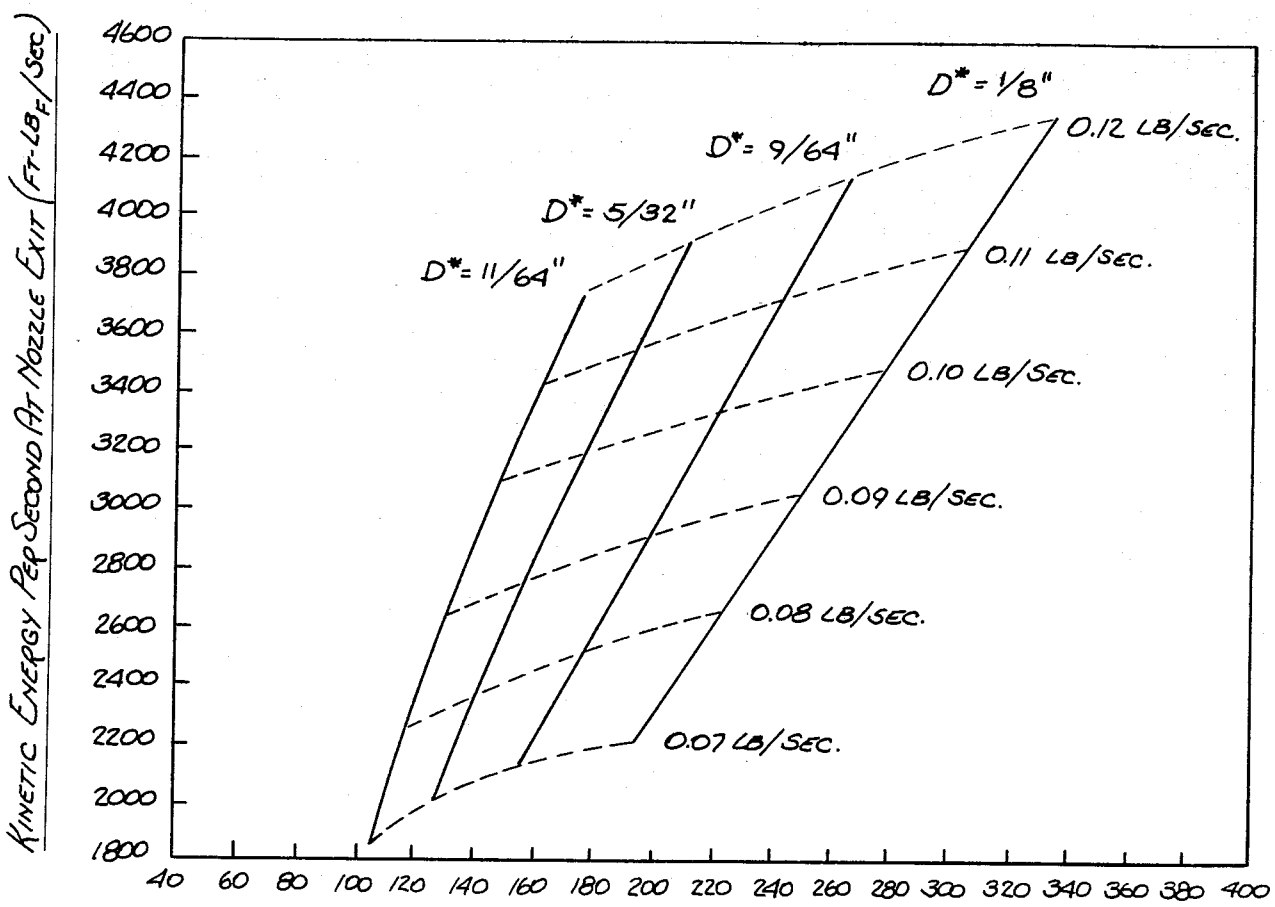

FIG. 6 depicts a relationship among argon driving pressure, jet exit diameter and energy generated at jet exit.

Generally speaking, the present invention contemplates the atomization of molten metal to powder whereby high total yields of powder are obtained with low gas consumption, the invention generally involving tapping a molten metal stream into a teeming vessel, particularly vessels of the tundish type, teeming the metal through a nozzle to form a molten stream and subjecting the molten stream to the action of an atomizing gas, the gas being dispensed through a plurality of jets arranged such that the molten stream is impacted by gas from at least two sets of jets (can be three or more), i.e., a primary set of jets and at least one secondary set as described above, with the included angle of the primary set in relation to the molten stream advantageously being greater than the included angle of the secondary set. This double impact mode system (or greater) provides for high total yields of powder with minimum argon consumption as will become more evident from the following.

The following information is given on the basis of treating 100-lb. melts from a furnace. Larger tanks, plenum chambers, etc., could be used upon scale-up to larger size melts.

TUNDISH

The tundish (holding vessel) should be capable of holding a portion of a melt at depths up to 10 inches or more, a preferred depth being from 6 to 10 inches depending upon teeming rate. A 6-inch diameter vessel has been found quite satisfactory for 100-lb. melts, though larger sizes would be desirable for larger size melts. The tundish should preferably be heated separate from the furnace and be capable of maintaining the melt up to desired temperature, advantageously about 100° F. above the liquidus (approximately up to 2900° F. in the case of nickel and/or cobalt base superalloys).

It might be mentioned that the temperature at which the melt is tapped from the melt furnace to the tundish is important. While it must, of course, be sufficiently high to prevent freeze-up in the tundish nozzle, it should be low enough such that the atomized particles solidify rapidly with fine grains and low oxygen pick-up.

TEEMING NOZZLE

The teeming nozzle is supported in the tundish, its function being to meter the molten metal into the atomization zone. While a teeming nozzle of the smooth bore venturi, FIG. 2(*a*), is generally used, it is sometimes deemed, however, more advantageous to use a sharp-edged orifice nozzle of the type illustrated in FIG. 2(*b*). And this obtains even though this type of nozzle might offer less resistance-to-turbulence in the tundish than would the venturi profile.

The orifice type nozzle above mentioned was arrived at as a result of extended investigation and experimentation. We have found that it is beneficial by reason of a low discharge coefficient, approximately 0.65–0.75 in comparison with unity as is the case generally with standard nozzles. This offers a larger opening for a given flow rate. Yet, it maintains sufficient stream stability. Therefore, alloys prone to "nozzle blockage", e.g., those having a large solidification range, can be teemed more successfully because of the larger opening required for a given flow rate. It has the additional advantage as a result of the smaller mass of nozzle to conduct heat away from the metering restriction. This results in reduced heat losses from the metering zone. Moreover, our investigations reflect that the atomizing medium tends to accelerate about the sharp orifice edge and this lends to removing initial precipitation of a nozzle blockage.

Beneficially the teeming or tundish nozzle is of a ceramic such as zirconia. In minimizing nozzle blockage, a throat diameter of about 3/16 to 11/32 inch is generally satisfactory. For venturi or smooth bore nozzles, a throat diameter of ⅛ to 5/16 inch is generally suitable.

As an aside and with other atomization parameters held constant, the smaller nozzle diameters give smaller powder particles, this at the expense of slower teeming rates and higher gas consumption. Conversely, the larger nozzles result in coarser particles, faster teeming rates and lower gas consumption.

TEEMING RATE

The metal teeming rate from the tundish is influenced principally by the throat diameter of the nozzle (they are approximately proportional) and by the head of metal in the tundish (teeming rate being virtually proportional to the square root of the melt height in the tundish). For a given gas flow rate, the lower teeming rates produce smaller powder particles. To avoid excessive fines and unnecessary gas consumption, it is of benefit to control the rate of teeming between about 10 and 65 kg/min. and more preferably from about 18 to 40 kg/min, the teeming nozzle throat diameter being above about 0.2 inch and up to about 0.34 inch, particularly from about 0.23 to 0.30 inch.

PLENUM CHAMBER

An illustrative plenum chamber is set forth in FIG. 3, again in rather schematic fashion.

While the plenum can take virtually any shape, it is preferred that it be substantially that of a hollow torroid (akin to a hollow annulus), to thereby permit the metal being teemed to pass through the central hole thereof and to feed argon to the gas jets at the bottom. The outside surface can, of course, be modified for ease of fabrication. The diameter of the central hole should be at least about 1½ or 1¾ inches to permit sufficient clearance for the metal stream. On the bottom surface of the plenum, spaces are provided to receive into place the desired number of gas jets.

The diameter of the circle through the center of the holes ("jet circle diameter") used to secure the jets can be from about 2 to 6 inches or more, it being preferred that it be from about 2½ to 4 inches. A jet circle diameter of 3 to 3⅛ inches is a good compromise, given the need to keep the metal stream away from the gas jets and the need to extend the gas jets close to the atomization zone to minimize energy losses in the gas.

The chamber should withstand pressures up to at least 600 psi, and be adapted to receive gas on both sides as shown in FIG. 3. A gauge can be used outside the atomizer to record the driving gas pressure for the gas jets via a third tube into the plenum.

GAS JET PROFILE

The gas jets, which can be formed of any suitable material, e.g., brass, should be of the venturi converging-diverging type. Such jets accelerate the gas smoothly up to the throat where it reaches, say, Mach 1, and then accelerate it along the gradually diverging bore to from, say, Mach 1 up to Mach 5 at the exit. Past the exit, gas velocity decreases, but maintains a supersonic tongue up to 3 inches or more.

The two most important dimensions of the jets are throat diameter and length of tapered section. The finish of the base should be as smooth as possible without abrupt changes in cross section. The design and dimensions of preferred jet embodiments is depicted in FIG. 4. Jet No. AA differs from A in the ½-inch additional lengths, i.e., length of exit, extension from plenum and length of jet. The same applies to Jets B and BB and Jets C and CC.

GAS JET ASSEMBLAGE

While the invention is not restricted to any specific number of jets, in accordance herewith it is most preferred that eight, approximately equally spaced, jets be utilized. Four of the jets, the "second set", strike the falling molten stream below the other four, i.e., the "first set" as shown in FIG. 5. This provides for the above-mentioned "double impact mode" with the second set creating the narrow powder cone profile as depicted in FIG. 5.

To secure the jets, plugs can be welded into the plenum and allowed to protrude slightly beyond the bottom surface. The faces of the plugs can be machined to provide seats for the gas jets and to ensure they are aimed correctly.

The direction in which the jets exhaust the gas is of considerable importance. The included angle of the jets (FIG. 5) of the "first set" should not exceed 30° and most beneficially is not more than about 25° to 27°, the preferred angle being about 24° to 26°, given preferred teeming rates. With regard to the "second set" of jets, while the included angle could be that of the primary set, it is much preferred that it be less than that of the "first set" and preferably be at least 2° or 3° less, the preferred included angle being from about 21° to 23°. The two angles for alternate opposed jets contain the powder spray in a tight or narrow cone. It might be added that lower energy jets perform better if the included angles are increased slightly to decrease the distance over which the energy decays. Higher energy jets require the smaller included angles.

In terms of the mass flow rate of gas delivered from the jet exits, it is most preferred that an exit velocity of at least Mach No. 1.5 be reached, particularly a velocity greater than Mach No. 2.0. In this connection, the energy (kinetic) available at the jet exit largely depends upon the gas driving pressure and throat diameter. This is depicted in FIG. 6, the information being based upon theoretical considerations. Thus, the same energy generated with a relatively large throat diameter can be generated with a jet of smaller diameter provided the driving pressure is increased. The reduction in gas consumed by reason using a high driving gas pressure and smaller throat diameter is balanced by the higher gas velocity, hence higher kinetic energy, at the jet exit.

However, there is a limit to how far the jet exit diameter can be decreased since to maintain the mass flow rate of gas requires that the gas be disproportionately increased. For a given Mach number the length of the supersonic cone of gas delivered to the atomization zone decreases much in proportion to the decrease in exit diameter. Put another way, the smaller the exit diameter, the less effective is the energy transfer from jet to atomization site.

ATOMIZATION TANK

The above components, tundish, plenum, nozzles, etc., operate within a chamber (not shown in FIG. 1) which for many alloys, including the super-alloys, is maintained under vacuum during melting. This chamber should be capable of holding a vacuum of 10 um of Hg or less, and can be varied in size depending upon the number of metal streams to be atomized, given a narrow powder cone profile. For 100 lb. melts and atomizing a single molten stream a tank 4 feet in diameter and 20 feet below the tundish, has proved satisfactory.

The bulk of the powder can be collected in a water cooled skip car at the bottom of the tank. By holding under argon in a quasi-fluidized state for a predetermined time, e.g., 2 hours, oxygen pick-up is minimized. It is also to advantage that above about 3 psig in the tank, the argon be exhausted through a cyclone or the like to remove entrained particles.

AUTOMIZATION PREPARATION

To avoid contamination from one alloy to the next, it may be necessary to "blow down" any prior accumulated powder in the vessel or exhaust gas scrubber. Compressed air can be used.

Raw materials should be free from refractory phases to minimize tundish nozzle blockage.

The tundish nozzle should be arranged such that the molten stream is teemed vertially down onto the focal points of the jets. An offset of even ¼-inch reduces efficiency.

Backfilling with the gaseous medium, e.g., argon, is recommended prior to atomization. This reduces extreme pressure difference between the plenum and jet exits.

The following information and data are given as illustrative of the invention:

Terminology:

$$\text{Recovery (\%)} = \frac{\text{Total Powder Weight}}{\text{Melt Weight}} \times 100$$

$$\text{Powder Yield (\%)} = \frac{\text{Powder Weight at Size}}{\text{Total Powder Weight}} \times 100$$

$$\text{Total Yield (\%)} = \frac{\text{Powder Weight at Size}}{\text{Melt Weight}} \times 100$$

$$\text{Argon Used (ft.}^3\text{/KG)} = \frac{\text{Argon Volume}}{\text{Powder Weight at Size}}$$

Note: Powder "recovery" seldom exceeds 92–94% since the furnace and tundish can each contain up to, for example, 0.9 lb. of a 100 lb. melt as skulls. Thus, total yield values are influenced by the size of the skulls. Therefore, powder yield is considered more accurate than either powder recovery or total yield. With units larger than the laboratory scale used herein, this problem will be reduced. Longer runs minimize the beginning and end effects which are present for most of a 100 lb. melt run. A 200 lb. scale-up confirmed this.

A number of tests were conducted in respect of various well-known superalloys, the nominal aim compositions being given in Table I with the processing conditions, gas pressures, teeming rate, teeming and gas jet nozzle parameters, etc., being varied as detailed hereinafter.

TABLE I

| Alloy | Cr % | Co % | Ti % | Al % | Mo % | W % | Cb % | B % | Zr % | C % |
|---|---|---|---|---|---|---|---|---|---|---|
| 1 | 10 | 15 | 4.7 | 5.5 | 3 | — | — | .01 | .06 | .03 |
| 2 | 15.3 | 16.9 | 3.5 | 4.0 | 5 | — | — | .03 | — | .06 |
| 3 | 13 | 8.0 | 2.5 | 3.5 | 3.5 | 3.5 | 3.5 | .01 | .05 | .06 |
| 4* | 12.4 | 9.0 | 3.9 | 3.2 | 2.0 | 3.9 | — | .01 | .01 | .05 |
| 5** | 19 | — | 0.9 | 0.5 | 3.1 | — | 5 | .004 | — | .04 |
| 6 | 48 | — | 0.35 | — | — | — | — | — | — | — |

*alloy 4 contained 3% Ta

**alloy 5 contained 52.5% Ni, balance Fe, balance of alloys otherwise nickel

Generally, the tests involved tapping a 45 kg melt of superalloy into a tundish, the tapping temperature reflecting composition and being generally from about 2700° to 2850° F.

For purposes of comparison, Examples I and II are included to give some idea as to what might be expected with processing procedures which might be representative of some prior art procedures.

EXAMPLE I 45 kg of Alloy 2 were vacuum melted in an atomizer, tapped into a tundish and then teemed through a ¼ inch venturi type teeming nozzle at an average rate of about 23 kg/min. Argon was exhausted from a plenum chamber at 260 psig through a single set of four equi-spaced subsonic eliptical orifice jets (gas velocity Mach 1 or less) at an included angle of 30°, (no double impact mode). Each of the jets was rotated through 45° to impart a downward swirling motion to the gas (swirl mode). The resulting powder was collected, yield, particle size, etc. being determined.

The results are reported in Table II.

EXAMPLE II

In an attempt to reduce the average particle size of Alloy 2, the metal flow rate was restricted to give an increase in the ratio of mass rate of gas flow to alloy teeming rate. In this instance, a 7.32 inch (I.D.) orifice teeming nozzle was used, the argon pressure and orifice jet arrangement, including swirl mode, being much the same as in Example I.

The results are given in Table II.

TABLE II

| | −40 + 325 | −60 + 325 | −80 + 325 |
|---|---|---|---|
| Example I (Recovery 86.8%) | | | |
| Powder yield | 88.8% | 68.8% | 49.8% |
| Total yield | 77.0% | 59.7% | 43.2% |
| Argon consumed | 47.8ft $^3$/kg | 61.7ft$^3$/kg | 85.3ft$^3$/kg |
| Example II (Recovery 84.4%) | | | |
| Powder yield | 93.2% | 81.6% | 63.2% |
| Total yield | 78.7% | 68.9% | 53.3% |
| Argon consumed | 53.08ft$^3$/kg | 94.8ft$^3$/kg | 122.0ft$^3$/kg |

While particle size was reduced under the conditions of Example II, the results are not deemed very outstanding, given the amount of argon consumed.

EXAMPLE III

To demonstrate that simply directing more energy to the atomization zone by using supersonic venturi jets is not a panacea, 42 kg of Alloy 1 were vacuum melted in an atomizer, tapped at 1650° F. into a preheated tundish and teemed through a 5/16 inch diameter orifice nozzle at an average rate of about 18 kg/min. Argon was exhausted through 1.5 inch long venturi jets having throat diameters of 7.32 inch, a Mach No. of 1.7 being reached at the exit. Using a 2½ inch jet diameter circle four jets spaced 90° apart were aimed at the metal stream at an included angle of 25° (vs. 30° in Examples I & II).

In this instance the total yield of powder was 61.7% for −40+325 mesh and 22.6% for −80+325 mesh.

A satisfactory volume of argon was used, a higher Mach No. was achieved and more energy was delivered to the atomization zone. However, this single impace mode system resulted in a wide cone of coarse droplets and much flake at the tank walls, the result being a low total yield of powder.

EXAMPLE IV

This test serves to illustrate the marked improvement obtainable using 2 sets of venturi type gas jets (double impace mode) in combination with an orifice type teeming nozzle.

46 kg of Alloy 3 were vacuum melted, tapped at 2700° F. into a tundish preheated to 2200° F. and then teemed through a 9/32 inch diameter orifice nozzle at an average rate of about 16 kg/min. Argon was exhausted at 150 psig (vs. 260 in Examples I & II) through 1½ inch long venturi jets, the jets having a throat diameter of 5/32 inch. A Mach No. of 2.8 was determined at the exit. Using a 2½ inch jet diameter circle, four jets spaced 90° apart were directed at the stream at an included angle of 30°, with a second set of jets being alternately spaced at an included angle of 25°.

The results are given in Table III.

EXAMPLE V

The test of Example III was repeated with an average teeming rate of 18 kg/min., the argon being exhausted at 180 psig through 2 inch long venturi jets, having throat diameters of 5/32 inch, a 3.4 Mach No. being achieved at the exit. In this instance, the jet diameter circle was 3½ inches with the first set of jets being at an included angle of 25° (vs 30° in Example III) and the second set at 22° (vs 25° in Example III). In this case, powder temperature was measured at the bottom of the tank. A maximum temperature of approximately 600° F. was determined.

TABLE III

| | Example IV (Recovery 94.8%) | | |
|---|---|---|---|
| | −40 + 325 | −60 + 325 | −80 + 325 |
| Powder yield | 91.6% | 71.8% | 54.1 |
| Total yield | 87.0% | 68.2% | 51.3 |
| Argon Consumed | 29.3ft$^3$/kg | 37.8ft$^3$/kg | 49.8ft$^3$/kg |
| | Example V (Recovery 96.0%) | | |
| Powder yield | 91.5 | 74.0% | 55.1% |
| Total yield | 87.8 | 71.0% | 55.7 |
| Argon Consumed | 41.1ft$^3$/kg | 50.8ft$^3$/kg | 64.8ft$^3$/kg |

A comparison of the data in Tables II and III reflect the dramatic reduction in argon consumption with marked improvement in recovery and yield.

As will become evident from additional data presented infra, the results given in Table III are by no means the best that can be achieved. But in simply comparing Tables II and III it will be noted that the total yield of the finer particle size, i.e., −80+325 powder, was greater in respect of Examples IV and V and yet the argon consumed was decidedly less.

EXAMPLE IV

As indicated above herein, a correlation of orifice nozzle, teeming rate, venturi jets, etc. is required to generate high efficiency. This is reflected by virtue of a test run in which a high metal teeming rate was used in conjunction with a large nozzle, though a double mode impact system was employed at favorable included angles to the falling molten streams.

Thus, approximately 45 kg of Alloy 4 were vacuum melted, tapped at 2700° F. into a tundish preheated to 2200° F., and teemed through an 11/32 inch diameter orifice nozzle at an average rate of 34 kg/min. Argon at 120 psig was exhausted through 2 inch long venturi jets, having throat diameters of 5/32 inch. A relatively high Mach No. 3.4 was reached at the exits. With a 3⅛ inch jet diameter circle, 4 jets were spaced 90° apart at an included angle of 25° with a second set of jets being alternately spaced at an included angle of 22°.

Total powder yield was but 72.4% over the −40+325 mesh range and 42.7% for the −80+325 mesh. Argon consumptions were 28.4 ft$^3$/kg and 48.1 ft$^3$/kg, respectively. It is believed the high teeming through a large nozzle exceeded the capability of the gas flow to cool the powder as would otherwise be the case. As this obtained notwithstanding that the energy level of the argon stream was high. It might be added that much of the powder, though useable, had caked together.

In Table IV, are set forth data derived by reason of varied operating parameters, e.g., teeming nozzle diameter, argon pressure, jet design type, etc. These later developed jets were made not only to accelerate the gas through the throat and diverging sections, but also to maintain that velocity in the confines of a tubular section (D of FIG. 4) to the exit. The teeming rate for Runs 1-A, 1-B, 1-C, 2 and 3 was about 23 kg/min, the jet-to-impact distance being about 5.2 inches.

Castellated nozzles (Runs 4-A and 4-B) were also used, the purpose being to further minimize melt turbulence (which was low) around the tundish nozzle and to produce smoother teeming streams. Such nozzles do not significantly affect any melt turbulence, at least on a small scale basis.

A constant argon driving pressure was attempted for the complete cycle run, the results being shown under tests 5 and 6. As will be understood by those skilled in the art, start-up and end conditions in terms of driving pressure differ from that experienced over the major part of the teeming cycle.

The jet-to-impact distance was altered from the 5.2 inch distance in the case of tests 7 and 8 (also tests 9–13). In these instances the distance was 4.7 inches (jet "AA" being ½-inch longer than "A"). It will be observed that generally there was an increase in powder yield in the small mesh sizes, i.e., −80 and −100 mesh.

In tests 9 through 13 the teeming nozzle diameter was varied over the range of 0.29 to 0.36 inch. In ll instances a baffle was used (terminated about 1.5 inch above the nozzle), the objective being to minimize any melt turbulence which might arise while filling or any tendency for the melt to form a vortex while emptying. The 0.36 inch nozzle diameter did result in lower yields. However, given a relatively short steady teeming rate for a 100 lb. melt test (approx. 15 seconds) it is thought that this masks the true effects of changes in nozzle diameters.

As referred to above herein, a distinct commercial advantage of the subject invention is that the narrow cone profile permits of multiple atomization of molten streams in apparatus which could not be so used with other processes. In this connection the two liquid streams were spaced about 5¾ inches apart. One tundish was used, the tundish being fitted with two nozzles, two plenum chambers and two sets of jets. The venturi jets used here, E, had a converging section (120°), a parallel throat section and a diverging section (6°) extending to the exit. These differed from the others largely in that the latter had tubular extensions to the exit. While the tests, Nos. 14–16, Table 4, were far from being refined, nonetheless they confirmed that multiple stream atomization could be conducted.

Table V offers a comparison of powder yields and argon consumption as a function of particle size for each of the three different jet embodiments set forth in FIG. 4, to wit, AA, BC and C. The teeming nozzle diameter was 0.27 inch, jet circle diameter 3.125 inch, with the same nozzle arrangement of 4 jets at 25° and 4 alternate at 22°. It should be pointed out that 200 lb. melts of superalloy were used. As can be seen from the data, performance was quite satisfactory.

In the above discussion of the invention, reference has been made to argon as the gaseous medium. However, other gases can be used, including inert gases generally, nitrogen, carbon monoxide, helium can be used. Depending upon the nature of the alloy processed, oxidizing gases, including air and oxygen can be used. Even water might be used as the atomizing medium. Too, while the invention contemplated the atomization of alloys, it is equally applicable to the atomization of metals per se. Also, conceptually the invention might be applicable to the disintegration of molten streams other than alloys or metals.

While a number of specific superalloys have been above referred to, and while the invention is particularly directed to otherwise difficultly workable alloys, notably those containing more than about 4 or 5% of the precipitation hardening elements aluminum and titanium, or a goodly precentage of matrix stiffening elements, molybdenum, niobium, tantalum, tungsten, vanadium, etc., the invention is, of course, applicable to alloys in general. Among the superalloys are those containing up to 60%, e.g., 1% to 25%, chromium; up to 30%, e.g., 5% to 25%, cobalt; up to 10%, e.g., 1% to 9%, aluminum; up to 8%, e.g., 1% to 7%, titanium, and particularly those alloys containing 4 or 5% or more of aluminum plus titanium; up to 30%, e.g., 1% to 8%, molybdenum; up to 25% e.g., 2% to 20%, tungsten; up to 10% columbium; up to 10% tantalum, up to 7% zirconium; up to 0.5% boron; up to 5% hafnium; up to 2% vanadium; up to 6% copper; up to 5% manganese; up to 70% iron; up to 4% silicon, and the balance essentially nickel. Cobalt-base alloys of similar composition can be treated. Among the specific superalloys might be listed IN-738 and 792, Rene alloys 41 and 95, Alloy 718, Waspaloy, Astroloy, Mar-M alloys 200 and 246, Alloy 713, Alloys 500 and 700, A-286, etc. Various of these alloys are more workable than others. Other base alloys such as titanium can be processed as well as refractory alloys such as SU-16, TZM, Zircaloy, etc. Prealloys contemplated herein can contain up to 10% or more by volume of a dispersoid such as $Y_2O_3$, $THO_2$, $La_2O_3$, etc.

Finally, it will be understood that modifications and variations of the invention may be resorted to without departing from the spirit and scope thereof as those skilled in the art will readily understand. Such are considered to be within the purview and scope of the invention and appended claims.

TABLE IV

| Test No. | Teeming Nozzle Dia (in) | Jet Circle Dia (in) | Gas Jets Type | Gas Jets Positioning/ Included Angle | Argon Pressure, Psig | −40 Mesh Powder Yield % | −40 Mesh Argon Consumed ft³/kg | −80 Mesh Powder Yield % | −80 Mesh Argon Consumed ft³/kg | −100 Mesh Powder Yield % | −100 Mesh Argon Consumed ft³/kg |
|---|---|---|---|---|---|---|---|---|---|---|---|
| 1-A | 0.250 | 3.125 | A | 4 @ 25, 4 @ 22 | 90–200 | 98.3 | 30.8 | 79.7 | 38.0 | 60.3 | 50.2 |
| 1-B | " | " | " | " | " | 97.9 | 31.3 | 76.4 | 40.0 | 56.9 | 53.8 |
| 1-C | " | " | " | " | " | 97.9 | 37.3 | 77.7 | 46.8 | 56.4 | 64.1 |
| 2 | " | " | " | " | 90–190 | 98.8 | 37.5 | 80.9 | 45.8 | 60.4 | 61.4 |
| 3 | " | " | " | " | 90–165 | 98.0 | 36.3 | 74.1 | 48.1 | 52.6 | 67.7 |
| | | | | | Castallated Teeming Nozzle | | | | | | |
| 4-A | " | " | " | " | 90–200 | 98.9 | 36.4 | 80.2 | 45.0 | 57.3 | 62.8 |
| 4-B | " | " | " | " | " | 98.4 | 39.4 | 81.6 | 47.6 | 64.6 | 60.1 |
| | | | | | Comparison of Constant High And Low Argon Pressure | | | | | | |
| 5 | " | " | " | " | 200 | 98.3 | 40.6 | 82.9 | 48.2 | 63.4 | 63.0 |
| 6 | " | " | " | " | 150 | 96.0 | 28.7 | 64.1 | 43.1 | 41.9 | 65.8 |
| | | | | | Change In Jet-To-Impact Distance | | | | | | |
| 7* | " | " | AA | " | 90–200 | 97.4 | 40.5 | 83 | 47.4 | 66.1 | 60.4 |
| 8** | " | " | " | " | 150–200 | 97.2 | 38.6 | 82.1 | 46 | 61.7 | 61.3 |
| | | | | | Teeming Nozzle Varied | | | | | | |
| 9 | 0.29 | " | AA | " | 150–200 | 94.7 | 27.6 | 67.3 | 39.2 | 52.8 | 50.0 |
| 10 | 0.31 | " | " | " | " | 96.3 | 28.4 | 75.3 | 36.3 | 56.4 | 45.5 |
| 11 | 0.33 | " | " | " | 150–200 | 94.0 | 28.1 | 71.6 | 36.9 | 58.0 | 45.4 |
| 12 | 0.33 | " | " | " | 150–200 | 90.7 | 29.1 | 67.3 | 39.2 | 52.8 | 50.0 |
| 13 | 0.36 | " | " | " | 150–200 | 66.3 | 30.3 | 44.5 | 45.2 | 33.5 | 60.2 |
| 14 | 0.25 | " | — | " | 90–180 | 94.4 | 29.0 | 52.2 | 52.5 | 30.9 | 86.6 |
| 15 | 0.25 | " | — | " | 90–180 | 97.3 | 36.6 | 55.2 | 64.4 | 34.9 | 102.0 |
| 16 | 0.28 | " | — | " | 90–150 | 97.4 | 36.1 | 73.5 | 47.7 | 53.3 | 65.7 |

TABLE V

Comparison of Powder Yields and Argon Consumption As Function or Particle Size For Three Preferred But Different Jet Designs. Nozzle Digm. 0.27 inch, Jet Circle Digm. 3.125 inches, Melt Size 200 lb.

| Test No. | Jet Type | Argon Pressure, Psig | −40 Mesh Powder Yield, % | −40 Mesh Argon Consumed ft³/kg | −80 Mesh Powder Yield, % | −80 Mesh Argon Consumed ft³/kg | −100 Mesh Powder Yield, % | −100 Mesh Argon Consumed ft³/kg |
|---|---|---|---|---|---|---|---|---|
| 17-A | C | 330 | 97.2 | 16.2 | 85.6 | 18.4 | 71.8 | 22.0 |
| 17-B | C | 250 | 92.5 | 15.2 | 76.3 | 18.5 | 61.5 | 22.9 |
| 18-A | BB | 250 | 97.4 | 14.9 | 80.3 | 18.1 | 61.8 | 23.5 |
| 18-B | BB | 200 | 93.5 | 12.1 | 71.1 | 15.9 | 55.9 | 20.2 |
| 19-A | AA | 200 | 95.9 | 13.2 | 76.8 | 16.5 | 61.9 | 20.4 |
| 19-B | AA | 150 | 93.7 | 11.5 | 67.2 | 16.1 | 48.6 | 22.2 |

We claim:

1. An atomization process for producing metal powder through gaseous disintegration of a molten stream in an atomizing tank using a controlled multiple impact mode system as herein defined and which by reason of such multiple impact mode, as opposed to an otherwise single impact mode, (i) powder loss through filigree formation (powder adherence to the interior wall of the atomizing tank) is minimized, (ii) powder loss through flake formation (powder deflecting from the interior tank wall) is reduced, (iii) a higher yield of metal powder is achieved, the foregoing being achievable (iv) though gas pressure and gas consumption be relatively low, which comprises, (a) directing molten metal in a downwardly stream through a venturi teeming nozzle at a rate of from about 10 to about 65 kg/min, (b) directing jets of gas through venturi jets to impinge against the molten metal stream to atomize said stream and thereby cool the stream such that droplets form, (c) said gas being delivered from the jets at an exit velocity of at least Mach. No. 1 such that a supersonic tongue of up to at least three inches is maintained and under a multiple impact mode system in which gas impinges against the stream at least twice at precisely determined but different locations using at least two groups of separate jets with a first group of jets being angled downwardly relative to the falling metal stream such that the gaseous medium dispensed therefrom at supersonic velocity strikes the molten metal at a first point downstream, and with at least a second group of downwardly angled jets arranged such that the gaseous medium dispensed therefrom at supersonic velocity strikes the metal at a second point downstream but below the said first point of impact and at an angle different from the first at least about 1° less than the first angle of impact, (d) and thereafter further cooling the droplets formed to complete the powder formation process.

2. A process as set forth in claim 1, the metal is teemed through a teeming nozzle having a throat diameter of about 0.2 inch and up to about 0.34 inch and in which a first group of jets are arranged as a plurality of substantially equally spaced primary jets, the angles formed between the jets and the falling molten stream being not greater than 15°, and a second group of jets are arranged as a plurality of substantially equally spaced jets with the respective angles between these jets and the falling molten stream being not greater than 13.5°, the jets of the second group being spaced in a substantially alternate relation to the said primary jets.

3. A process as set forth in claim 2 in which the angles formed by the respective primary jets and molten stream are about 12° to 13.5° and the angles formed by the respective secondary jets and molten stream are about 10.5° to 11.5° but at least 1° less than the angles formed by the primary jets.

4. A process as set forth in claim 1 in which the exit velocity of the gas delivered from the jets is at least about Mach No. 1.5.

5. A process as set forth in claim 1 in which the exit velocity of the gas delivered from the jets is at least about Mach No. 2.

6. A process as set forth in claim 1 in which the gas used is inert in respect of the metal being atomized.

7. A process as set forth in claim 6 in which the gas is argon.

8. A process as set forth in claim 7 in which argon is used as the gas and the kinetic energy generated at the exits of the jets is a correlation of the argon driving pressure and jet throat diameter as set forth in FIG. 6.

9. A process as set forth in claim 2 in which the gas is argon, the molten metal to be atomized is tapped into a tundish, teemed from the tundish at a teeming rate of about 18 to 40 kg/min. through a teeming nozzle having a throat diameter of about 0.2 inch to about 0.34 inch, and the kinetic energy generated at the exits of the jets is a correlation of the argon driving pressure and jet throat diameter as set forth in FIG. 6.

10. An atomization process for producing metal powder through disintegration of a molten stream in an atomizing tank using a controlled multiple impact mode system as herein defined and which by reason of such multiple impact mode as opposed to an otherwise single impact mode, (i) powder loss through filigree formation (powder adherence to the interior wall of the atomizing tank) is minimized, (ii) powder loss through flake formation (powder deflecting from the interior tank wall) is reduced, (iii) a higher yield of metal powder is achieved, which comprises, (a) directing molten metal in a downwardly stream through a teeming nozzle at a rate of from about 10 to about 65 kg/min, (b) directing jets of an atomizing fluid to impinge against the molten metal stream to atomize said stream and thereby cool the stream such that droplets form, (c) said atomizing fluid being delivered from the jets at an exit velocity of at least Mach No. 1 such that a supersonic tongue of up to at least three inches is maintained and under a multiple impact mode system in which atomizing fluid impinges against the stream at least twice at precisely determined but different locations using at least two groups of separate jets, with a first group of jets being angled downwardly relative to the falling metal stream such that the atomizing fluid dispensed therefrom at supersonic velocity strikes the molten metal at a first point downstream, and with at least a second group of downwardly angled jets arranged such that the atomizing fluid dispensed therefrom at supersonic velocity strikes the metal stream at a second point downstream but below the said first point of impact and at an angle different from the first at least about 1° less than the first angle of impact, (d) and thereafter further cooling the droplets formed to complete the powder formation process.

11. A process as set forth in claim 10 in which the atomizing fluid is selected from the group consisting of argon, nitrogen, carbon monoxide, helium, air, oxygen and water and in which a first group of jets are arranged as a plurality of substantially equally spaced primary jets, the angles formed between the jets and the falling molten stream being not greater than 15°, and a second group of jets are arranged as a plurality of substantially equally spaced jets with the respective angles between these jets and the falling molten stream being not greater than 13.5°, the jets of the second group being spaced in a substantially alternate relation to the said primary jets.

* * * * *

UNITED STATES PATENT AND TRADEMARK OFFICE

CERTIFICATE OF CORRECTION

PATENT NO. : 4,272,463

DATED : June 9, 1981

INVENTOR(S) : Ian S. R. Clark and John K. Pargeter

It is certified that error appears in the above-identified patent and that said Letters Patent is hereby corrected as shown below:

Column 3, line 24 : "2(1)" should read -- 2(a) --

Column 8, line 23 : "1650°F" should read -- 2650°F --

Column 8, line 27 : "7.32" should read -- 7/32 --

Column 9, line 24 : "IV" should read -- VI --

Column 10, line 12 : "11" should read -- all --

Signed and Sealed this

*Twenty-third* Day of *October 1984*

[SEAL]

*Attest:*

GERALD J. MOSSINGHOFF

*Attesting Officer*

*Commissioner of Patents and Trademarks*